US007453482B2

(12) United States Patent
Nakatani

(10) Patent No.: US 7,453,482 B2
(45) Date of Patent: Nov. 18, 2008

(54) IMAGE GENERATING APPARATUS

(75) Inventor: Masaki Nakatani, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 156 days.

(21) Appl. No.: 11/454,785

(22) Filed: Jun. 19, 2006

(65) Prior Publication Data

US 2006/0284963 A1 Dec. 21, 2006

(30) Foreign Application Priority Data

Jun. 20, 2005 (JP) ..... 2005-179436

(51) Int. Cl.
*B41J 2/32* (2006.01)
*B41J 2/335* (2006.01)

(52) U.S. Cl. ..... 347/171; 347/197

(58) Field of Classification Search ..... 347/171, 347/197, 198, 222, 223; 400/120.16
See application file for complete search history.

(56) References Cited

U.S. PATENT DOCUMENTS 4,963,886 A 10/1990 Fukuda et al.
5,245,356 A * 9/1993 Ota et al. ..... 347/197
5,366,302 A * 11/1994 Masumura et al. ..... 400/120.16

FOREIGN PATENT DOCUMENTS

JP 61-199877 A 12/1986
JP 05-278299 A 10/1993
JP 07-111558 A 4/1995
JP 2000-058151 A 2/2000

OTHER PUBLICATIONS

European Search Report dated Oct. 4, 2006 (four (4) pages).

* cited by examiner

*Primary Examiner*—K. Feggins
(74) *Attorney, Agent, or Firm*—Crowell & Moring LLP

(57) ABSTRACT

An image generating apparatus allowing reduction of the thickness of a heat radiation member and allowing strong mounting of a holding member also when a print head is arranged on the forward end of a screw member is obtained. This image generating apparatus comprises a print head, a heat radiation member, arranged on the upper surface of the print head, including a mounting portion protruding toward the head of a screw member and having a threaded hole meshing with the screw member and a holding member, mounted on the upper surface of the heat radiation member with the screw member, having a mounting portion receiving hole capable of receiving the mounting portion of the heat radiation member and holding a prescribed member.

18 Claims, 8 Drawing Sheets

IMAGE GENERATING APPARATUS

BACKGROUND OF THE INVENTION

1. Field of the Invention

The present invention relates to an image generating apparatus, and more particularly, it relates to an image generating apparatus comprising a print head.

2. Description of the Background Art

A thermal transfer printer is known as an image generating apparatus comprising a print head. The structure of a print head 100 employed for such a conventional thermal transfer printer is described with reference to FIG. 16.

As shown in FIG. 16, the exemplary conventional print head 100 has a head portion 110 for printing pictures (characters), a rotary arm 120 rotatably supporting the head portion 110 and an ink sheet guide member 130 for guiding an ink sheet 150.

The head portion 110 generates heat, thereby thermally transferring ink from the ink sheet 150 passing through the space between the head portion 110 and a platen roller 140 to a paper 160. The rotary arm 120 includes a heat sink 121, provided on the upper surface of the head portion 110, having a function of radiating the heat from the head portion 110. The heat sink 121 has a thickness D1 (about 3.0 mm) in a direction A shown in FIG. 16. The heat sink 121 of the rotary arm 120 is formed with a threaded hole 121*a* meshing with a screw 170. The ink sheet guide member 130 having a thickness D2 (about 1.0 mm) in the direction A is arranged on the upper surface of the heat sink 121. This ink sheet guide member 130 has a guide portion 131 for guiding the ink sheet 150 in a carrying direction and a screw receiving hole 132 receiving the screw 170. The ink sheet guide member 130 is mounted on the heat sink 121 by fastening the screw 170 into the threaded hole 121*a* of the heat sink 121 through a washer 180 and the screw receiving hole 132 of the ink sheet guide member 130. At this time, the screw 170 is fastened into the threaded hole 121*a* of the heat sink 121 by a depth (screw margin) D3 (about 2.5 mm), whereby the ink sheet guide member 130 is strongly mounted on the heat sink 121 of the rotary arm 120.

If the thickness D1 (about 3.0 mm) of the heat sink 121 is reduced in order to reduce the amount of the material for the heat sink 121 provided with the ink sheet guide member 130 as well as the cost in the print head 100 mounted on the conventional thermal transfer printer shown in FIG. 16, however, the screw margin D3 (about 2.5 mm) of the heat sink 121 to which the screw 170 is fastened is so reduced that it is difficult to strongly mount the ink sheet guide member 130 on the heat sink 121.

On the other hand, a facsimile or a thermal printer is also known in general as an image generating apparatus, comprising a print head, other than the thermal transfer printer.

For example, Japanese Patent Laying-Open No. 7-111558 (1995) or 5-278299 (1993) discloses such an image generating apparatus.

The aforementioned Japanese Patent Laying-Open No. 7-111558 discloses a facsimile having a head spring arranged between a thermal head (print head) and an upper chassis and mounted on the upper chassis with a screw for uniformizing pressing force for pressing the thermal head against a thermal recording paper.

The aforementioned Japanese Patent Laying-Open No. 5-278299 discloses a thermal printer having a pressing member, employed for pressing a thermal head against a paper, mounted on a head supporter provided with the thermal head with a screw through a plate spring. In the thermal printer disclosed in Japanese Patent Laying-Open No. 5-278299, a printing position of the thermal head is controlled by adjusting the amount of fastening the screw fixing the head supporter provided with the thermal head, the plate spring and the pressing member.

In the facsimile disclosed in the aforementioned Japanese Patent Laying-Open No. 7-111558, however, the thickness (screw margin) of the upper chassis to which the screw is fastened is so reduced that it is difficult to strongly mount the head spring on the upper chassis if the upper chassis is thinned in order to reduce the amount of the material for the upper chassis provided with the head spring as well as the cost, similarly to the conventional thermal transfer printer shown in FIG. 16. Also in the thermal printer disclosed in the aforementioned Japanese Patent Laying-Open No. 5-278299, the thickness (screw margin) of the pressing member to which the screw is fastened is so reduced that it is difficult to strongly mount the head supporter on the pressing member if a portion of the pressing member to which the screw is fastened is thinned in order to reduce the amount of the material for the pressing member on which the head supporter is mounted with the screw as well as the cost, similarly to the conventional thermal transfer printer shown in FIG. 16.

In relation to this, there is generally proposed a structure increasing the thickness (screw margin) of a portion of a member to which a screw is fastened in order to strongly mount a prescribed member on the member to which the screw is fastened.

For example, Japanese Patent Laying-Open No. 2000-58151 or Japanese Utility Model Laying-Open No. 61-199877 (1986) discloses an image generating apparatus having such a structure.

The aforementioned Japanese Patent Laying-Open No. 2000-58151 discloses a facsimile machine having a connecting terminal arranged on the upper surface of a mounting seat extending from a chassis and mounted on the mounting seat with a screw. The mounting seat of the chassis of the facsimile machine disclosed in Japanese Patent Laying-Open No. 2000-58151 is formed with a portion, including a threaded hole meshing with the screw, protruding toward the forward end of the screw (opposite to the head of the screw) for increasing the size of a portion (screw margin) to which the screw is fastened.

The aforementioned Japanese Utility Model Laying-Open No. 61-199877 discloses a terminal fitting mounted on a terminal board. In the terminal fitting disclosed in Japanese Utility Model Laying-Open No. 61-199877, a portion, including a threaded hole meshing with a screw, is formed to protrude toward the forward end of the screw (opposite to the head of the screw) for increasing the size of a portion (screw margin) to which the screw is fastened. The screw is fastened into the threaded hole through a lead wire, thereby strongly fixing the lead wire.

In the facsimile machine disclosed in the aforementioned Japanese Patent Laying-Open No. 2000-58151, however, it is difficult to arrange a member such as a precision machine on the forward end of the screw due to the portion, to which the screw is fastened, formed to protrude toward the forward end of the screw. The terminal fitting disclosed in the aforementioned Japanese Utility Model Laying-Open No. 61-199877 also has a problem similar to that of the aforementioned Japanese Patent Laying-Open No. 2000-58151.

SUMMARY OF THE INVENTION

The present invention has been proposed in order to solve the aforementioned problems, and an object of the present invention is to provide an image generating apparatus allowing reduction of the thickness of a heat radiation member and allowing strong mounting of a holding member also when a print head is arranged on the forward end of a screw member.

In order to attain the aforementioned object, an image generating apparatus according to a first aspect of the present invention comprises a print head, a heat radiation member, arranged on the upper surface of the print head, including a mounting portion protruding toward the head of a screw member and having a threaded hole meshing with the screw member and a holding member, mounted on the upper surface of the heat radiation member with the screw member, having a mounting portion receiving hole capable of receiving the mounting portion of the heat radiation member and holding a prescribed member.

In the image generating apparatus according to the first aspect, as hereinabove described, the heat radiation member is provided with the mounting portion protruding toward the head of the screw member and including the threaded hole meshing with the screw member and the holding member is provided with the mounting portion receiving hole capable of receiving the mounting portion of the heat radiation member so that a portion (screw margin) to which the screw member is fastened extends to a root portion close to the head of the screw member through the mounting portion receiving hole of the holding member, whereby the length of the portion (screw margin) to which the screw member is fastened can be increased by the amount of protrusion of the mounting portion toward the head of the screw member when the holding member is mounted on the heat radiation member through the screw member. Consequently, the holding member can be strongly mounted on the heat radiation member. In this case, the mounting portion protruding toward the head of the screw member can sufficiently ensure the screw margin for the fastened screw member also when the thickness of the heat radiation member is reduced, whereby the heat radiation member can be reduced in thickness. Further, the mounting portion including the threaded hole meshing with the screw member so protrudes toward the head of the screw member that the mounting portion of the heat radiation member protrudes oppositely to a print head arranged on the forward end to which the screw member is fastened, whereby the protruding mounting portion can be prevented from coming into contact with the print head. Consequently, the holding member can be strongly mounted on the heat radiation member without damaging the print head arranged on the forward end of the screw member.

In the aforementioned image generating apparatus according to the first aspect, a recess portion is preferably provided on a surface of the mounting portion of the heat radiation member closer to the print head. According to this structure, flashes (protuberances) formed on an end surface of the threaded hole of the mounting portion of the heat radiation member closer to the print head when the threaded hole of the mounting portion of the heat radiation member is worked remain in the recess portion without coming into contact with the print head, whereby the flashes can be inhibited from coming into contact with the print head. Consequently, damage of the print head can be suppressed.

In the aforementioned image generating apparatus having the recess portion provided on the surface the mounting portion of the heat radiation member closer to the print head, the recess portion of the heat radiation member is preferably so formed as to store a forward end portion, protruding toward the print head, of the screw member mounted on the mounting portion of the heat radiation member. According to this structure, the whole of a threaded portion of the screw member excluding the forward end is fastened to the mounting portion of the heat radiation member, whereby the holding member can be strongly mounted on the heat radiation member.

The aforementioned image generating apparatus according to the first aspect preferably further comprises a platen roller against which the print head is pressed, a rotary arm integrally formed on the heat radiation member for rotatably supporting the print head and a pressing member for pressing the print head against the platen roller, while the prescribed member held by the holding member is preferably a spring member pressed by the pressing member thereby urging the print head toward the platen roller. According to this structure, the holding member holding the spring member for pressing the print head against a paper can be strongly mounted on the heat radiation member.

In the aforementioned image generating apparatus according to the first aspect, the holding member preferably includes a guide portion for guiding an ink sheet employed for printing with the print head. According to this structure, the guide portion can properly guide a spent ink sheet in a carrying direction, while the holding member is so strongly mounted on the heat radiation member as described above that the same is not detached also when force for upwardly pushing the holding member acts on the guide portion due to tension of the spent ink sheet as carried.

In the aforementioned image generating apparatus according to the first aspect, the amount of protrusion of the mounting portion of the heat radiation member is preferably not more than the thickness of the holding member. According to this structure, the upper surface of the holding member is protrudable toward the head of the screw member beyond the upper surface of the mounting portion of the heat radiation member. Thus, the screw member can be fastened into the threaded hole of the mounting portion of the heat radiation member in a state coming into contact with the holding member. Consequently, the holding member can be reliably mounted on the heat radiation member.

In this case, the image generating apparatus preferably further comprises a washer, arranged between the mounting portion of the heat radiation member and the screw member, having a larger outer diameter than the mounting portion of the heat radiation member, for pressing the upper surface of the holding member with the washer by fastening the screw member into the threaded hole of the mounting portion of the heat radiation member through the washer. According to this structure, the holding member can be reliably fixed.

In the aforementioned image generating apparatus comprising the heat radiation member formed with the mounting portion and the recess portion, the mounting portion and the recess portion of the heat radiation member are preferably formed by performing press working from the side of the lower surface of the heat radiation member. The mounting portion and the recess portion can be simultaneously formed by performing press working from the side of the lower surface of the heat radiation member as described above.

In the aforementioned image generating apparatus according to the first aspect, the heat radiation member is preferably made of aluminum. According to this structure, heat of the print head can be efficiently radiated while keeping strength necessary for working the mounting portion protruding toward the head of the screw member.

In the aforementioned image generating apparatus according to the first aspect, the heat radiation member is preferably provided with a boss while the holding member is preferably provided with a boss receiving hole capable of receiving the boss of the heat radiation member. According to this structure, the holding member can be easily positioned with respect to the heat radiation member by fitting the boss of the heat radiation member into the boss receiving hole of the holding member.

In the aforementioned image generating apparatus according to the first aspect, the guide portion is preferably integrally formed on the holding member mounted on the upper surface of the print head so that an end coming into contact with the ink sheet is folded to have a curved outer surface. The guide portion is so integrally provided on the holding member that the ink sheet is guidable without increasing the number of components. Further, the end of the guide portion coming into contact with the ink sheet is so curved as to inhibit the ink sheet from getting caught during carriage. Consequently, the ink sheet can be smoothly carried without increasing the number of components.

An image generating apparatus according to a second aspect of the present invention comprises a print head, a heat radiation member arranged on the upper surface of the print head, a rotary arm integrally formed on the heat radiation member for rotatably supporting the print head, a platen roller against which the print head is pressed, a pressing member for pressing the print head against the platen roller and a holding member, mounted on the upper surface of the heat radiation member with a screw member, holding a spring member for urging the print head toward the platen roller by being pressed by the pressing member, the heat radiation member is provided with a mounting portion protruding toward the head of the screw member and including a threaded hole meshing with the screw member while a recess portion is provided on a surface of the mounting portion of the heat radiation member closer to the print head for storing a forward end portion, protruding toward the print head, of the screw member mounted on the mounting portion of the heat radiation member, and the holding member includes a mounting portion receiving hole capable of receiving the mounting portion of the heat radiation member protruding toward the head of the screw member and a guide portion for guiding an ink sheet employed for printing with the print head.

In the image generating apparatus according to the second aspect, as hereinabove described, the heat radiation member is provided with the mounting portion protruding toward the head of the screw member and including the threaded hole meshing with the screw member and the holding member is provided with the mounting portion receiving hole capable of receiving the mounting portion of the heat radiation member so that a portion (screw margin) to which the screw member is fastened extends to a root portion close to the head of the screw member through the mounting portion receiving hole of the holding member, whereby the length of the portion (screw margin) to which the screw member is fastened can be increased by the amount of protrusion of the mounting portion toward the head of the screw member when the holding member is mounted on the heat radiation member through the screw member. Consequently, the holding member can be strongly mounted on the heat radiation member. In this case, the mounting portion protruding toward the head of the screw member can sufficiently ensure the screw margin for the fastened screw member also when the thickness of the heat radiation member is reduced, whereby the heat radiation member can be reduced in thickness. Further, the mounting portion including the threaded hole meshing with the screw member so protrudes toward the head of the screw member that the mounting portion of the heat radiation member protrudes oppositely to a print head arranged on the forward end to which the screw member is fastened, whereby the protruding mounting portion can be prevented from coming into contact with the print head. Consequently, the holding member can be strongly mounted on the heat radiation member without damaging the print head arranged on the forward end of the screw member. Further, the recess portion is so provided on the surface of the mounting portion of the heat radiation member closer to the print head that flashes (protuberances) formed on an end surface of the threaded hole of the mounting portion of the heat radiation member closer to the print head when the threaded hole of the mounting portion of the heat radiation member is worked remain in the recess portion without coming into contact with the print head, whereby the flashes can be inhibited from coming into contact with the print head. Consequently, damage of the print head can be suppressed. In addition, the recess portion of the heat radiation member is so formed as to store the forward end, protruding toward the print head, of the screw member mounted on the mounting portion of the heat radiation member so that the whole of a threaded portion of the screw member excluding the forward end is fastened to the mounting portion of the heat radiation member, whereby the holding member can be strongly mounted on the heat radiation member. Further, the holding member is provided with the guide portion for guiding the ink sheet employed for printing with the print head so that the guide portion can properly guide a spent ink sheet in a carrying direction, while the holding member is so strongly mounted on the heat radiation member as described above that the same is not detached also when force for upwardly pushing the holding member acts on the guide portion due to tension of the spent ink sheet as carried.

In the aforementioned image generating apparatus according to the second aspect, the amount of protrusion of the mounting portion of the heat radiation member is preferably not more than the thickness of the holding member. According to this structure, the upper surface of the holding member is protrudable toward the head of the screw member beyond the upper surface of the mounting portion of the heat radiation member. Thus, the screw member can be fastened into the threaded hole of the mounting portion of the heat radiation member in a state coming into contact with the holding member. Consequently, the holding member can be reliably mounted on the heat radiation member.

In this case, the image generating apparatus preferably further comprises a washer, arranged between the mounting portion of the heat radiation member and the screw member, having a larger outer diameter than the mounting portion of the heat radiation member, for pressing the upper surface of the holding member with the washer by fastening the screw member into the threaded hole of the mounting portion of the heat radiation member through the washer. According to this structure, the holding member can be reliably fixed.

In the aforementioned image generating apparatus comprising the heat radiation member formed with the mounting portion and the recess portion, the mounting portion and the recess portion of the heat radiation member are preferably formed by performing press working from the side of the lower surface of the heat radiation member. The mounting portion and the recess portion can be simultaneously formed by performing press working from the side of the lower surface of the heat radiation member as described above.

In the aforementioned image generating apparatus according to the second aspect, the heat radiation member is preferably made of aluminum. According to this structure, heat of the print head can be efficiently radiated while keeping strength necessary for working the mounting portion protruding toward the head of the screw member.

In the aforementioned image generating apparatus according to the second aspect, the heat radiation member is preferably provided with a boss while the holding member is preferably provided with a boss receiving hole capable of receiving the boss of the heat radiation member. According to this structure, the holding member can be easily positioned with respect to the heat radiation member by fitting the boss of the heat radiation member into the boss receiving hole of the holding member.

In the aforementioned image generating apparatus according to the second aspect, the guide portion is preferably integrally formed on the holding member mounted on the upper surface of the print head so that an end coming into contact with the ink sheet is folded to have a curved outer surface. The guide portion is so integrally provided on the holding member that the ink sheet is guidable without increasing the number of components. Further, the end of the guide portion coming into contact with the ink sheet is so curved as to inhibit the ink sheet from getting caught during carriage. Consequently, the ink sheet can be smoothly carried without increasing the number of components.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is now described with reference to the drawings.

First, the structure of a thermal transfer printer according to this embodiment is described with reference to FIGS. 1 to 12. This embodiment of the present invention is applied to the thermal transfer printer, which is an exemplary image generating apparatus.

Figure 1:
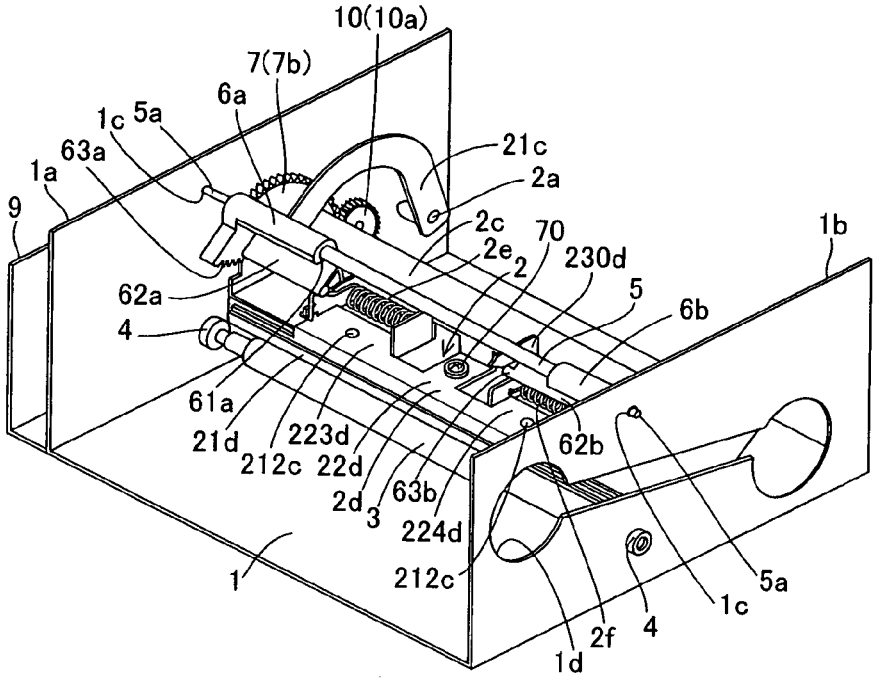
FIG. 1 is a perspective view showing the internal structure of a thermal transfer printer according to an embodiment of the present invention.
Figure 2:
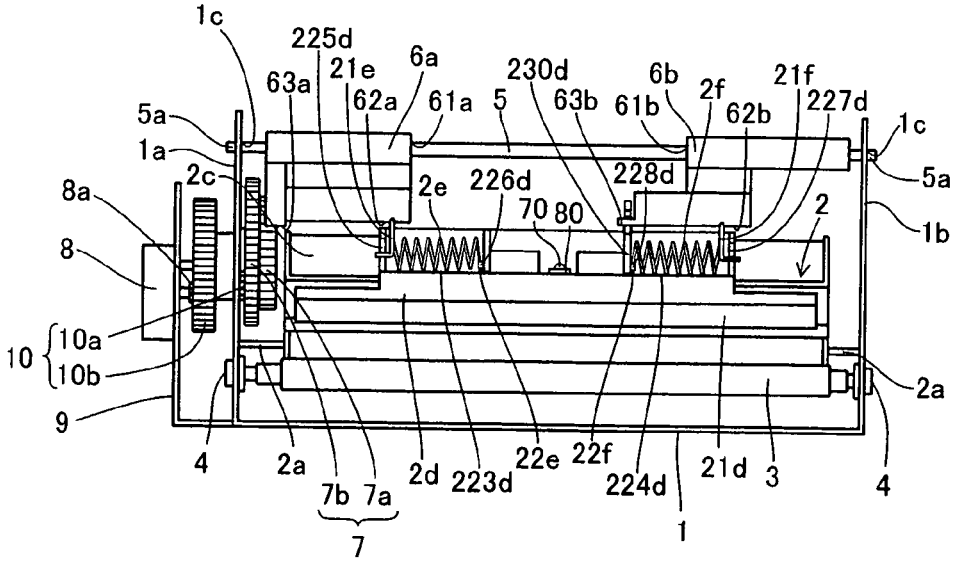
FIG. 2 is a front elevational view of the thermal transfer printer according to the embodiment shown in FIG. 1.

The thermal transfer printer according to this embodiment comprises a metal chassis 1, a print head 2 for printing, a platen roller 3, two platen roller bearings 4, a metal support rod 5, head portion pressing members 6*a* and 6*b* for pressing the print head 2, a resin drive gear 7, a motor 8 (see FIG. 2), a motor bracket 9 and an intermediate gear 10, as shown in FIGS. 1 and 2.

The chassis 1 has first and second side surfaces 1*a* and 1*b* opposed to each other. The first and second side surfaces 1*a* and 1*b* of the chassis 1 are provided with support holes 1*c* for rotatably supporting the support rod 5 respectively. An ink sheet cartridge receiving hole 1*d* is provided on the second side surface 1*b* of the chassis 1, for receiving an ink sheet cartridge 40 (see FIG. 3).

The two platen roller bearings 4 are mounted on the first and second side surfaces 1*a* and 1*b* of the chassis 1 respectively, for rotatably supporting the platen roller 3.

Figure 4:
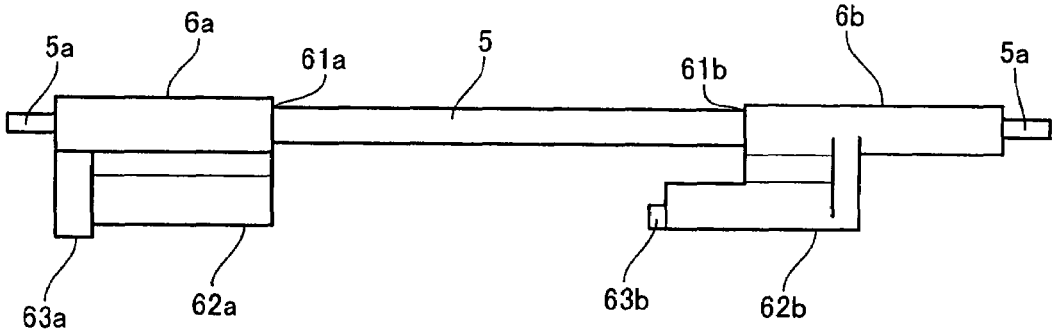
FIG. 4 is a front elevational view of a head portion pressing member and a shaft portion of the thermal transfer printer according to the embodiment shown in FIG. 1.
Figure 5:
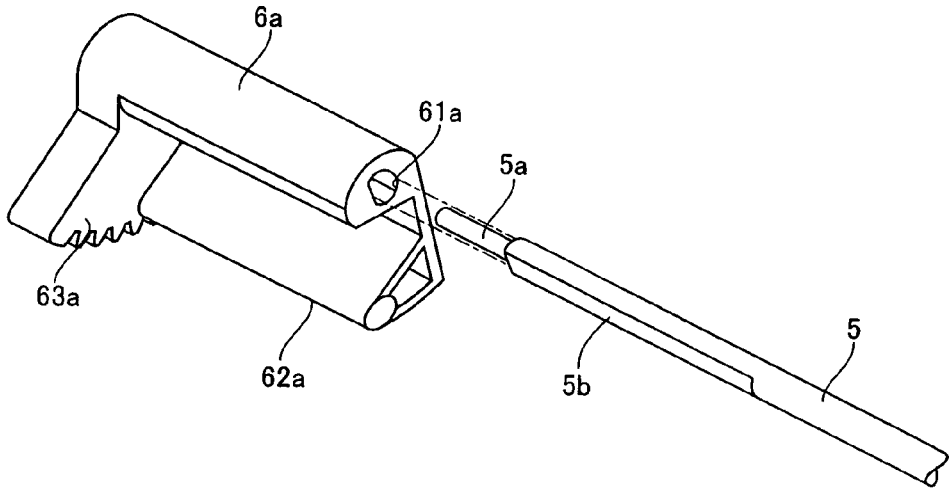
FIGS. 5 and 6 are perspective views for illustrating mounting structures of the head portion pressing member and the shaft portion of the thermal transfer printer according to the embodiment shown in FIG. 1.
Figure 6:
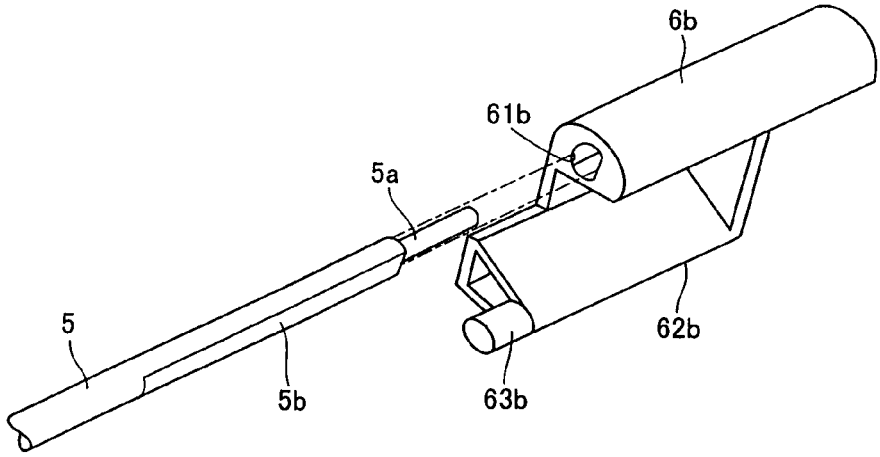

Support portions 5*a* are provided on both ends of the support rod 5 respectively. The support portions 5*a* of the support rod 5 are fitted into the support holes 1*c* provided on the first and second side surfaces 1*a* and 1*b* of the chassis 1 respectively. As shown in FIG. 4, the head portion pressing members 6*a* and 6*b* are mounted on both ends of the support rod 5 respectively unidly with respect to the support rod 5. More specifically, D-shaped insert portions 5*b* are provided in the vicinity of both ends of the support rod 5 respectively, as shown in FIGS. 5 and 6. The head portion pressing members 6*a* and 6*b* are examples of the "pressing member" in the present invention.

The head portion pressing members 6*a* and 6*b* are formed with D-shaped receiving holes 61*a* and 61*b* receiving the insert portions 5*b* provided in the vicinity of both ends of the support rod 5 respectively. Thus, the support rod 5 as well as the second head portion pressing member 6*b* rotate upon rotation of the first head portion pressing member 6*a*. The head portion pressing members 6*a* and 6*b* are arranged close to the first and second side surfaces 1*a* and 1*b* of the chassis 1 respectively, as shown in FIGS. 1 and 2.

The first head portion pressing member 6*a* is integrally formed with a pressing portion 62*a* and a gear portion 63*a*, as shown in FIG. 5. The second head portion pressing member 6*b* is integrally formed with a pressing portion 62*b* and a protuberance 63*b* protruding in the extensional direction of the support rod 5, as shown in FIG. 6.

Figure 7:
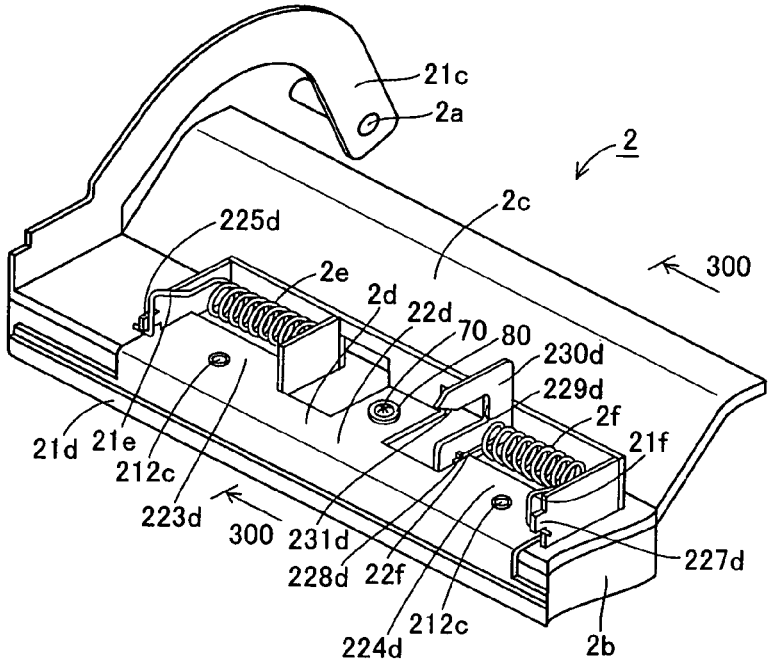
FIGS. 7 and 8 are perspective views showing the structure of a print head of the thermal transfer printer according to the embodiment shown in FIG. 1.
Figure 8:
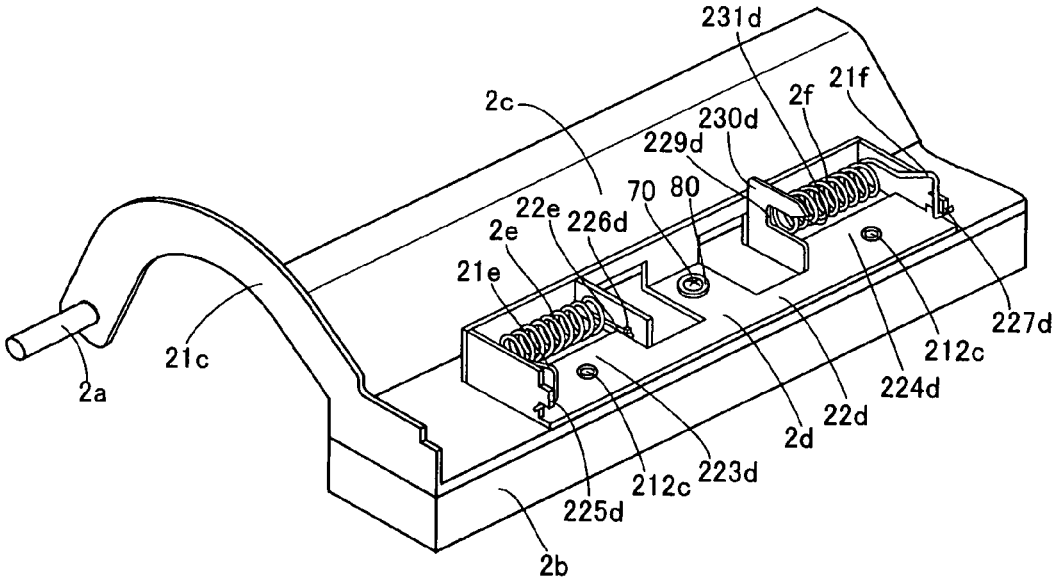
Figure 9:
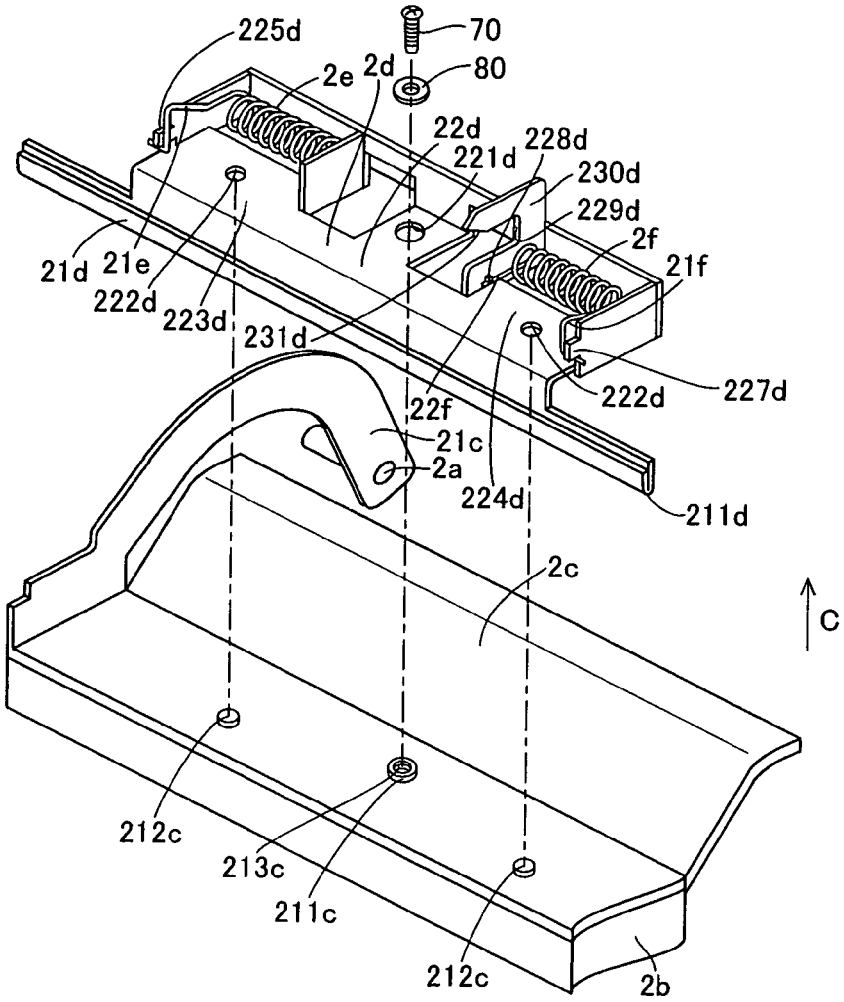
FIG. 9 is an exploded perspective view showing the structure of the print head of the thermal transfer printer according to the embodiment shown in FIG. 1.

As shown in FIGS. 7 to 9, the print head 2 has a pair of support shafts 2*a*, a head portion 2*b* opposed to the platen roller 3 (see FIGS. 1 and 2), a heat sink 2*c* of aluminum integrally formed with a pair of arms 21*c* coupling the support shafts 2*a* and the head portion 2*b* with each other and a spring holder 2*d* mounted on the heat sink 2*c*. The head portion 2*b* is an example of the "print head" in the present invention, and the spring holder 2*d* is an example of the "holding member" in the present invention. The heat sink 2*c* is an example of the "heat radiation member" in the present invention, and the arms 21*c* are examples of the "rotary arm" in the present invention. The print head 2 is so formed that the arms 21*c* mounted with the head portion 2*b* are rotatable about the support shafts 2*a*. In other words, the pair of support shafts 2*a* of the print head 2 are rotatably mounted on the first and second side surfaces 1*a* and 1*b* of the chassis 1 respectively.

Figure 3:
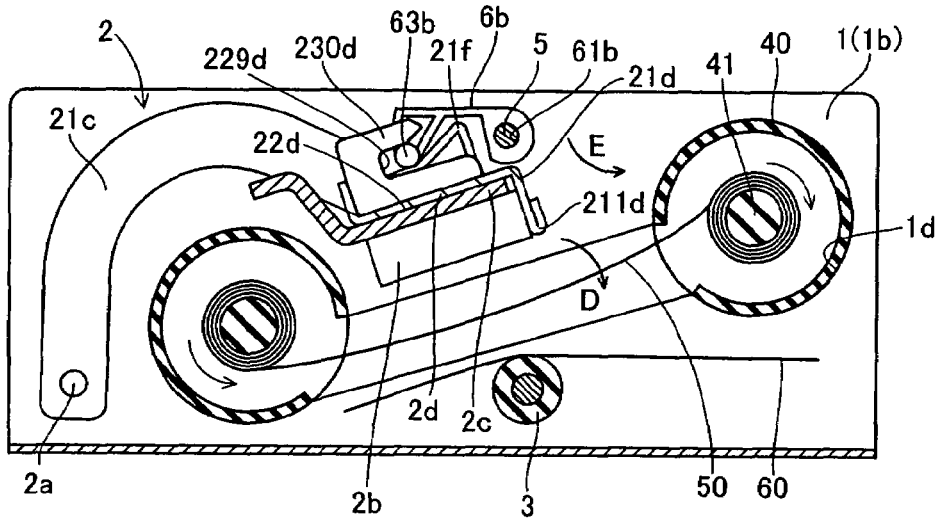
FIG. 3 is a sectional view of the thermal transfer printer according to the embodiment shown in FIG. 1 on which an ink sheet cartridge is mounted.

The head portion 2*b* generates heat, thereby printing a photograph or the like by thermally transferring ink from an ink sheet 50 (see FIG. 3) passing through the space between the head portion 2*b* and the platen roller 3 to a paper 60 (see FIG. 3). The heat sink 2*c* arranged on the upper surface of the head portion 2*b* has a function of radiating heat from the head portion 2*b*. A mounting portion 211*c* and two bosses 212*c* are formed on the upper surface of the heat sink 2*c*, as shown in FIG. 9. The heat sink 2*c* has a thickness D4 (about 2.0 mm) in a direction B shown in FIGS. 10 and 11.

According to this embodiment, the mounting portion 211*c* of the heat sink 2*c* is so formed as to protrude toward a head 71 (direction C in FIGS. 9 and 10) of a screw 70 having an outer diameter of about 2.6 mm. This mounting portion 211*c* has an outer diameter R1 (about 4.5 mm), and is formed with a threaded hole 213*c* meshing with the screw 70, as shown in FIG. 11. This threaded hole 213*c* has a screw margin of a length D5 (about 2.0 mm) in the direction B shown in FIG. 10. The boss 212*c*, provided for positioning the spring holder 2*d* as shown in FIG. 9, is so formed as to protrude in the direction C shown in FIG. 9. The boss 212*c* and the mounting portion 211*c* protruding in the direction C are formed by performing press working from the side of the lower surface of the heat sink 2*c*. As shown in FIG. 11, therefore, the mounting portion 211*c* is so formed that the thickness D4 of the heat sink 2*c* deviates by D6 (about 1.0 mm) in the direction C in FIG. 11. Thus, the mounting portion 211*c* protrudes from the upper surface of the heat sink 2*c* toward the head 71 of the screw 70 by D6 (about 1.0 mm). The amount D6 (about 1.0 mm) of protrusion of the mounting portion 211*c* is preferably set to be identical to or not more than the thickness (about 1.2 mm) of the spring holder 2*d* described later. Following this protrusion of the mounting portion 211*c* in the direction C of FIG. 11 by D6 (about 1.0 mm) due to the aforementioned press working, a recess portion 214*c* having a depth D6 (about 1.0 mm) in the direction C of FIG. 11 is formed on a surface of the mounting portion 211*c* of the heat sink 2*c* closer to the head portion 2*b*. This recess portion 214*c* stores a forward end portion 72, protruding toward the head 2*b*, of the screw 70 mounted on the mounting portion 211*c* of the heat sink 2*c*.

Figure 10:
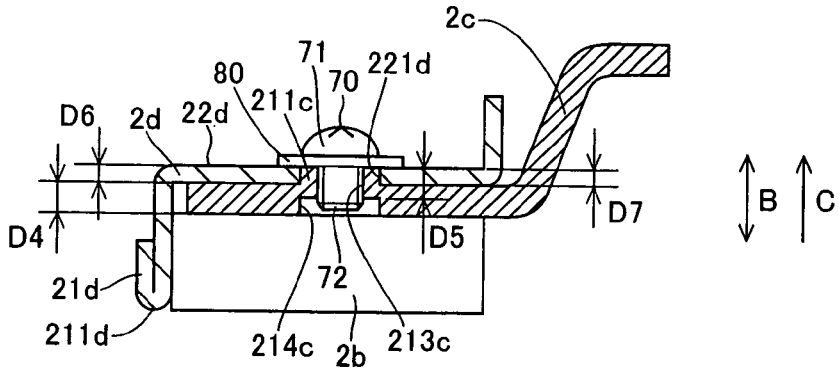
FIG. 10 is a sectional view of the print head taken along the line 300-300 in FIG. 7.
Figure 11:
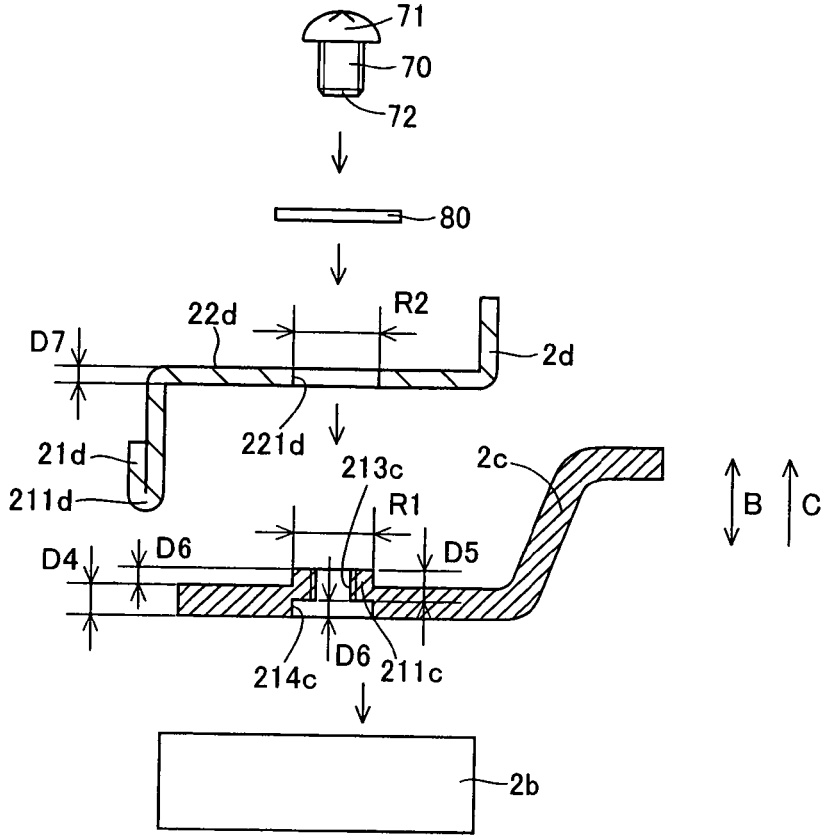
FIG. 11 is an exploded sectional view of the print head shown in FIG. 10.

According to this embodiment, the spring holder 2*d* is mounted onto the upper surface of the heat sink 2*c* through the screw 70 and a washer 80, as shown in FIGS. 10 and 11. In this case, the screw 70 is fastened into the threaded hole 213*c* of the mounting portion 211*c* of the heat sink 2*c* through the washer 80, so that the washer 80 presses the upper surface of the spring holder 2*d*. The spring holder 2*d* has a thickness D7 (about 1.2 mm) in the direction B of FIGS. 10 and 11. This spring holder 2*d* includes a guide portion 21*d* provided on a side of the head portion 2*b* in a paper carrying direction and a spring fixing portion 22*d* for fixing torsion coil springs 2*e* and 2*f* described later, as shown in FIGS. 9 to 11. The guide portion 21*d* has a function of guiding the spent ink sheet 50 (see FIG. 3) employed for printing pictures (characters) when the ink sheet 50 is taken up on the ink sheet cartridge 40 (see FIG. 3). A forward end portion 211*d* coming into contact with the ink sheet 50 is folded to have a curved outer surface.

According to this embodiment, the spring fixing portion 22*d* is provided on a position corresponding to the mounting portion 211*c* of the heat sink 2*c* with a mounting portion receiving hole 221*d* capable of receiving the mounting portion 211*c* of the heat sink 2*c* protruding toward the head 71 of the screw 70. This mounting portion receiving hole 221*d* has an inner diameter R2 (about 4.7 mm) larger than the outer diameter R1 (about 4.5 mm) of the mounting portion 211*c* of the heat sink 2*c*, as shown in FIG. 11. The aforementioned washer 80 has an outer diameter larger than the outer diameter R1 of the mounting portion 211. The spring fixing portion 22*d* is also provided on positions corresponding to the two bosses 212*c* of the heat sink 2*c* with positioning holes 222*d* capable of receiving the bosses 212*c*, as shown in FIG. 9. Thus, the spring holder 2*d* can be positioned with respect to the heat sink 2*c*.

The torsion coil springs 2*e* and 2*f* for urging the head portion 2*b* toward the platen roller 3 (see FIGS. 1 and 2) are arranged on regions of the spring fixing portion 22*d* corresponding to the head portion pressing members 6*a* and 6*b* (see FIGS. 1 and 2) respectively, as shown in FIGS. 7 to 9. More specifically, the spring fixing portion 22*d* includes spring fixing portions 223*d* and 224*d* for fixing the torsion coil springs 2*e* and 2*f* respectively. The torsion coil springs 2*e* and 2*f* are examples of the "spring member" in the present invention. The spring fixing portions 223*d* and 224*d* are arranged at a prescribed interval in the axial direction of the platen roller 3. The spring fixing portion 223*d* is provided with a stop portion 225*d* and a protrusion 226*d*. The spring fixing portion 224*d* is also provided with a stop portion 227*d* and a protrusion 228*d*.

The torsion coil spring 2*e* has a first end 21*e* pressed against the pressing portion 62*a* of the head portion pressing member 6*a* upon downward rotation of the head portion pressing member 6*a* and a second end 22*e* transmitting urging force resulting from the pressed first end 21*e* to the head portion 2*b*. The torsion coil spring 2*f* also has a first end 21*f* pressed against the pressing portion 62*b* of the head portion pressing member 6*a* upon downward rotation of the head portion pressing member 6*b* and a second end 22*f* transmitting urging force resulting from the pressed first end 21*f* to the head portion 2*b*. The head portion 2*b* is pressed against the platen roller 3 with the urging force of the torsion coil springs 2*e* and 2*f* transmitted thereto. The first end 21*e* of the torsion coil spring 2*e* is stopped on the stop portion 225*d* of the spring holder 2*d*, while the second end 22*e* thereof is fixed to the protrusion 226*d* of the spring holder 2*d*. Further, the first end 21*f* of the torsion coil spring 2*f* is stopped on the stop portion 227*d* of the spring holder 2*d*, while the second end 22*f* thereof is fixed to the protrusion 228*d* of the spring holder 2*d*.

Figure 12:
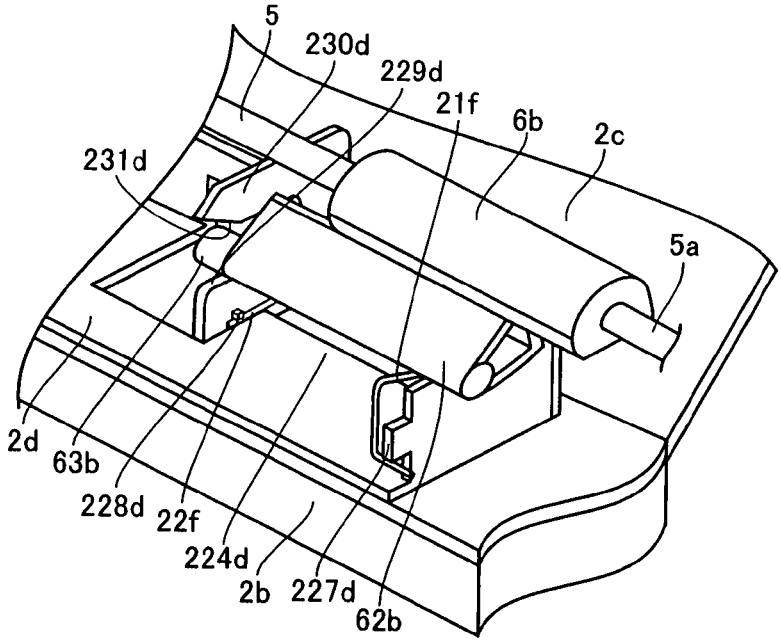
FIG. 12 is an enlarged detailed diagram of the head portion pressing member of the thermal transfer printer according to the embodiment shown in FIG. 1.

As shown in FIG. 12, an engaging portion 230*d* having a notch 229*d* engaging with the protuberance 63*b* of the head portion pressing member 6*b* is integrally formed on the spring fixing portion 224*d* of the spring holder 2*d*. When the head portion pressing member 6*b* rotates upward, therefore, the protuberance 63*b* of the head portion pressing member 6*b* and the notch 229*d* of the spring fixing portion 224*d* so engage with each other that the head portion 2*b* also rotates upward. Consequently, the head portion 2*b*, having been pressed against the platen roller 3 (see FIGS. 1 and 2), is separated from the platen roller 3 upon rotation of the head portion pressing member 6*b*. A chamfer 231*d* is formed on an opening side of the notch 229*d*, in order to simplify the engagement with the protuberance 63*b*.

As shown in FIGS. 1 and 2, the drive gear 7 and the intermediate gear 10 are provided for rotating the head portion pressing members 6*a* and 6*b* by transmitting driving force of the motor 8 thereto. The drive gear 7 and the intermediate gear 10 are mounted only on the first side surface 1*a* of the chassis 1. The motor 8 is mounted on the first side surface 1*a* of the chassis 1 through the motor bracket 9. A small diameter gear portion 7*a* of the drive gear 7 meshes with the gear portion 63*a* of the first head portion pressing member 6*a*, while a large diameter gear portion 7*b* of the drive gear 7 meshes with a small diameter gear 10*a* of the intermediate gear 10. A large diameter gear 10*b* of the intermediate gear 10 meshes with a motor gear 8*a* of the motor 8. Thus, driving of the motor 8 is transmitted to the first head portion pressing member 6*a* through the intermediate gear 10 and the drive gear 7.

A picture (character) printing operation of the thermal transfer printer according to this embodiment is now described with reference to FIGS. 2, 3 and 13 to 15.

Figure 13:
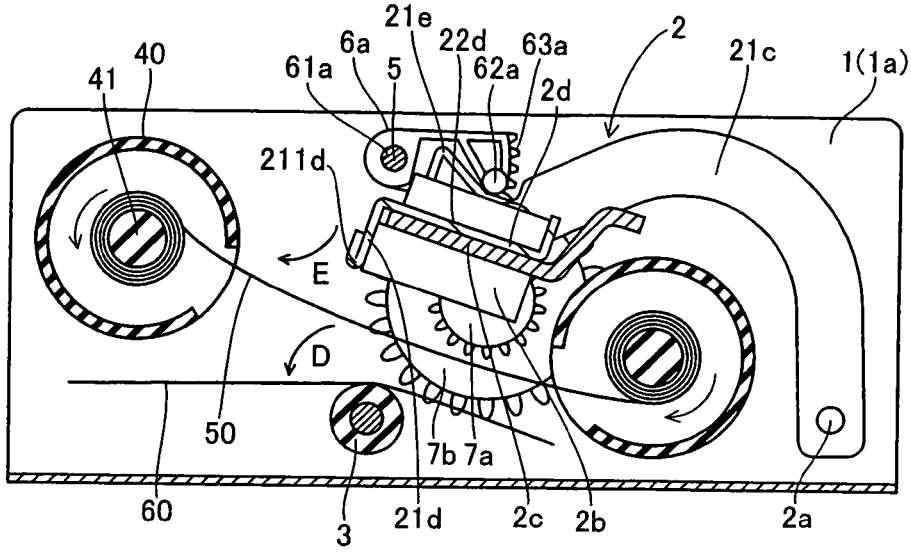
FIGS. 13 to 15 are sectional views for illustrating a printing operation of the thermal transfer printer according to the embodiment shown in FIG. 1.

In an initial state, the head portion 2*b* of the print head 2 is held on a spaced position with respect to the platen roller 3, as shown in FIGS. 3 and 13. At this time, the protuberance 63*b* of the head portion pressing member 6*b* engages with the notch 229*d* of the engaging portion 230*d* of the spring fixing portion 224*d* provided on the upper portion of the head portion 2*b* as shown in FIG. 3, thereby restraining the head portion 2*b* from rotation along arrow D in FIG. 3.

When the motor 8 (see FIG. 2) is driven from the initial state shown in FIG. 13, the driving force thereof is transmitted to the gear portion 63*a* of the head portion pressing member 6*a* through the intermediate gear 10 (see FIG. 2) and the drive gear 7, thereby rotating the head portion pressing member 6*a* about the support rod 5 along arrow E as shown in FIG. 13. At this time, the head portion pressing members 6*a* and 6*b* (see FIG. 2) remain unidling with respect to the support rod 5, whereby the head portion pressing member 6*b* is also rotated along arrow E. The head portion 2*b*, having been restrained from rotating along arrow D by the protuberance 63*b*, is also rotated along arrow D due to rotation of the protuberance 63*b* of the head portion pressing member 6*b* along arrow E. Thus, the head portion 2*b* is moved toward the platen roller 3 (press side), as shown in FIGS. 14 and 15.

Figure 14:
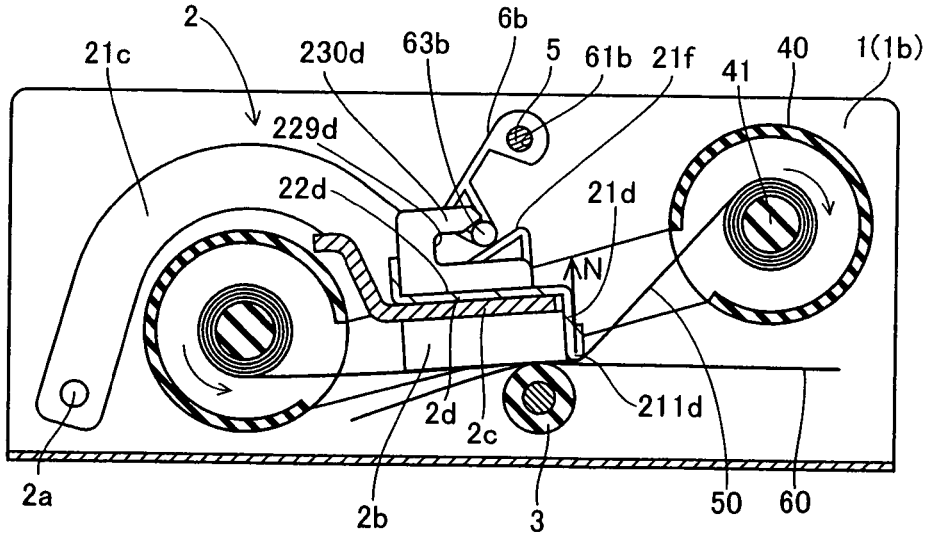
Figure 15:
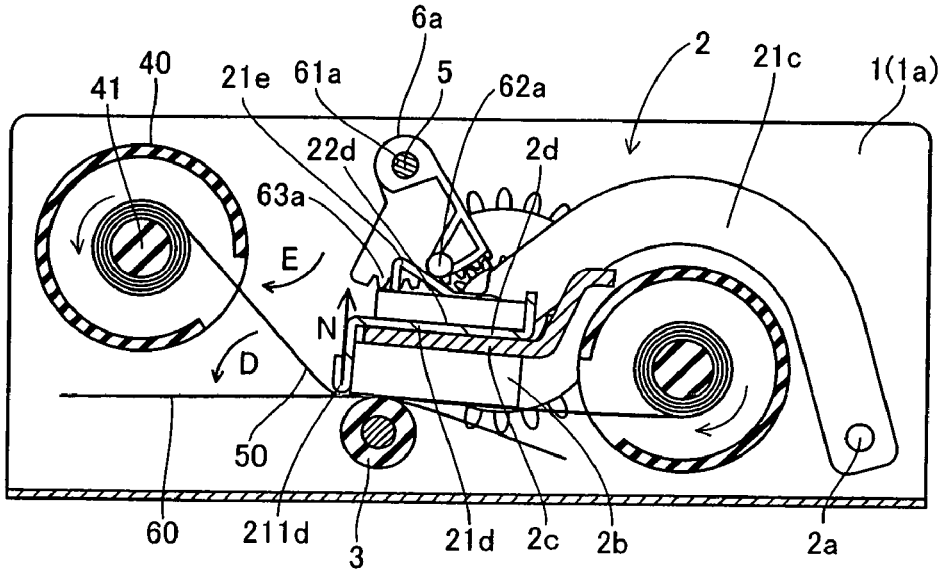

In this state where the print head 2 is moved toward the platen roller 3 as shown in FIGS. 14 and 15, the head portion pressing members 6*a* and 6*b* are further rotated along arrow E. Thus, the pressing portion 62*a* of the head portion pressing member 6*a* presses the first end 21*e* of the torsion coil spring 2*e* arranged on the spring holder 2*d*. Further, the pressing portion 62*b* of the head portion pressing member 6*b* presses the first end 21*f* of the torsion coil spring 2*f* arranged on the spring holder 2*d*. At this time, urging force is generated in the torsion coil springs 2*e* and 2*f* and transmitted to the head portion 2*b* through the second ends 22*e* and 22*f* of the torsion coil springs 2*e* and 2*f*. Thus, the head portion 2*b* is urged toward the platen roller 3. In this state, the engagement between the protuberance 63*b* of the head portion pressing member 6*b* and the notch 229*d* of the spring fixing portion 224*d* of the spring holder 2*d* is canceled.

The paper 60 (see FIG. 3) and the ink sheet 50 (see FIG. 3) arranged between the head portion 2*b* of the print head 2 and the platen roller 3 are carried in the carrying direction while the head portion 2*b* of the print head 2 is pressed against the platen roller 3, whereby the ink is transferred from the ink sheet 50 to the paper 60 for printing pictures (characters). Thereafter the spent ink sheet 50 is smoothly taken up on a bobbin 41 of the ink sheet cartridge 40 through the guide portion 21*d* of the spring holder 2*d*. At this time, the ink sheet 50 pulled by and taken up on the bobbin 41 of the ink sheet cartridge 40 generates prescribed tension. The ink sheet 50 generating the prescribed tension is taken up while coming into contact with the forward end portion 211*d* of the guide portion 21*d* of the spring holder 2*d*, to result in prescribed reaction N in the direction (upward direction) for detaching the spring holder 2*d* from the heat sink 2*c*. Thus, an image of a photograph or the like is printed on the paper 60.

Figure 16:
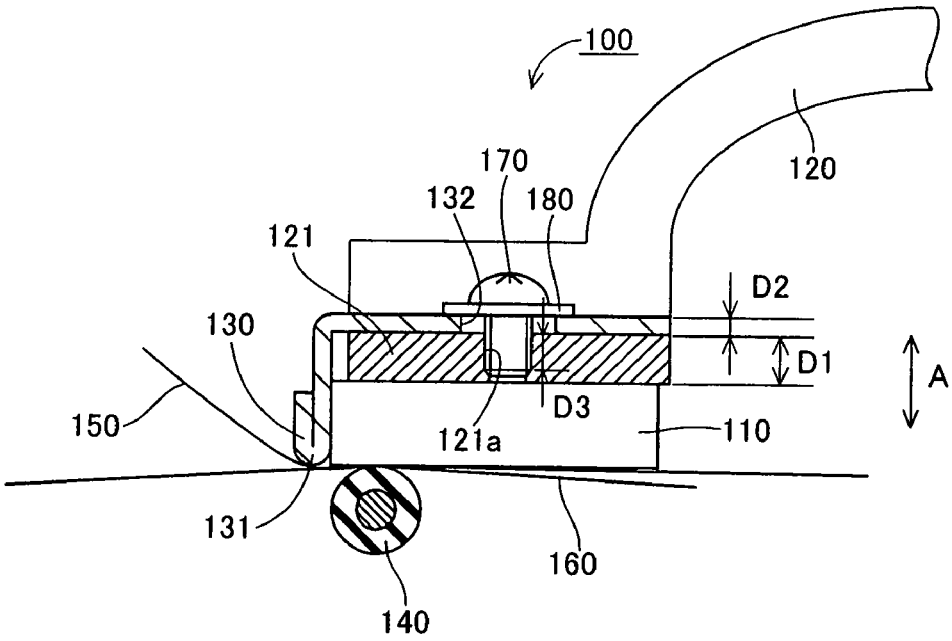
FIG. 16 PRIOR ART
FIG. 16 is a sectional view of a print head employed for an exemplary conventional thermal transfer printer.

According to this embodiment, as hereinabove described, the heat sink 2*c* integrally formed on the arms 21*c* of the print head 2 is provided with the mounting portion 211*c* protruding toward the head 71 of the screw 70 and including the threaded hole 213*c* meshing with the screw 70 while the spring holder 2*d* is provided with the mounting portion receiving hole 221*d* capable of receiving the mounting portion 211*c* of the heat sink 2*c* so that the threaded hole 213*c* of the mounting portion 211*c* to which the screw 70 is fastened extends to a root portion close to the head 71 of the screw 70 through the mounting portion receiving hole 221*d* of the spring holder 2*d*, whereby the length of the portion (screw margin) to which the screw 70 is fastened can be increased by the amount D6 (about 1.0 mm) of protrusion of the mounting portion 211*c* toward the head 71 of the screw 70 when the spring holder 2*d* is mounted on the heat sink 2*c* through the screw 70. Consequently, the spring holder 2*d* can be strongly mounted on the heat sink 2*c*. In this case, the mounting portion 211*c* protruding toward the head 71 of the screw 70 can sufficiently ensure the screw margin D5 (about 2.0 mm) for fastening the screw 70 despite the thickness D4 (about 2.0 mm) of the heat sink 2*c* smaller than the thickness D1 (about 3.0 mm) of the conventional heat sink 121 (see FIG. 16), whereby the thickness of the heat sink 2*c* can be reduced.

According to this embodiment, the mounting portion 211*c* including the threaded hole 213*c* meshing with the screw 70 so protrudes toward the head 71 of the screw 70 as to protrude oppositely to the head portion 2*b* arranged on the forward end to which the screw 70 is fastened, whereby the protruding mounting portion 211*c* can be inhibited from coming into contact with the head portion 2*b*. Consequently, the spring holder 2*d* can be strongly mounted on the heat sink 2*c* without damaging the head portion 2*b* arranged on the forward end portion 72 of the screw 70.

According to this embodiment, the recess portion 214*c* is provided on the surface of the mounting portion 211*c* of the heat sink 2*c* closer to the head 2*b* so that flashes (protuberances) formed on a surface of the threaded hole 213*c* of the mounting portion 211*c* of the heat sink 2*c* closer to the head portion 2*b* when the threaded hole 213*c* of the mounting portion 211*c* of the heat sink 2*c* is worked remain in the recess portion 214*c* without coming into contact with the head portion 2*b*, whereby the flashes can be inhibited from coming into contact with the head portion 2*b*. Consequently, damage of the head portion 2*b* can be suppressed.

According to this embodiment, the recess portion 214*c* of the heat sink 2*c* is so formed as to store the forward end portion 72, protruding toward the head portion 2*b*, of the screw 70 mounted on the mounting portion 211*c* of the heat sink 2*c* so that the whole of a threaded portion of the screw 70 excluding the forward end portion 72 is fastened into the threaded hole 213*c* of the mounting portion 211*c* of the heat sink 2*c*, whereby the spring holder 2*c* can be strongly mounted on the heat sink 2*c*.

According to this embodiment, the spring holder 2*d* is provided with the guide portion 21*d* for guiding the ink sheet 50 employed for printing with the head portion 2*b* so that the guide portion 21*d* can properly guide the spent ink sheet 50 in the carrying direction, while the spring holder 2*d* is so strongly mounted on the head sink 2*c* as described above that the same is not detached also when force N (see FIGS. 14 and 15) for upwardly pushing the spring holder 2*d* acts on the guide portion 21*d* due to tension of the spent ink sheet 50 as carried.

Although the present invention has been described and illustrated in detail, it is clearly understood that the same is by way of illustration and example only and is not to be taken by way of limitation, the spirit and scope of the present invention being limited only by the terms of the appended claims.

For example, while the aforementioned embodiment of the present invention is applied to the thermal transfer printer, the present invention is not restricted to this but is also applicable to another image generating apparatus other than the thermal transfer printer.

While the arms 21*c* are integrally formed on the heat sink 2*c* of the print head 2 in the aforementioned embodiment, the present invention is not restricted to this but the heat sink 2*c* and the arms 21*c* may alternatively be formed independently of each other.

While the guide portion 21*d* for guiding the ink sheet 50 is provided on the spring holder 2*d* in the aforementioned embodiment, the present invention is not restricted to this but a guide portion for guiding the ink sheet 50 may alternatively be provided on the heat sink 2*c*.

While the two torsion coil springs 2*e* and 2*f* are arranged on the spring holder 2*d* in order to urge the head portion 2*b* toward the paper 60 in the aforementioned embodiment, the present invention is not restricted to this but the head portion 2*b* may alternatively be urged toward the paper 60 with another urging member other than the torsion coil springs 2*e* and 2*f*.

What is claimed is:

1. An image generating apparatus comprising:

a print head;

a heat radiation member, arranged on the upper surface of said print head, including a screw mounting portion having a threaded hole meshing with a screw member; and a holding member, mounted on the upper surface of said heat radiation member with said screw member, having a mounting portion receiving hole capable of receiving said screw mounting portion of said heat radiation member and holding a prescribed member; wherein said screw mounting portion protrudes toward the head of said screw member.

2. The image generating apparatus according to claim 1, wherein a recess portion is provided on a surface of said mounting portion of heat radiation member closer to said print head.

3. The image generating apparatus according to claim 2, wherein said recess portion of said heat radiation member is so formed as to store a forward end portion, protruding toward said print head, of said screw member mounted on said mounting portion of said heat radiation member.

4. The image generating apparatus according to claim 2, wherein said mounting portion and said recess portion of said heat radiation member are formed by performing press working from the side of the lower surface of said heat radiation member.

5. The image generating apparatus according to claim 1, further comprising:

a platen roller against which said print head is pressed, a rotary arm integrally formed on said heat radiation member for rotatably supporting said print head, and a pressing member for pressing said print head against said platen roller, wherein said prescribed member held by said holding member is a spring member pressed by said pressing member thereby urging said print head toward said platen roller.

6. The image generating apparatus according to claim 1, wherein said holding member includes a guide portion for guiding an ink sheet employed for printing with said print head.

7. The image generating apparatus according to claim 6, wherein said guide portion is integrally formed on said holding member mounted on the upper surface of said print head so that an end coming into contact with said ink sheet is folded to have a curved outer surface.

8. The image generating apparatus according to claim 1, wherein the amount of protrusion of said mounting portion of said heat radiation member is not more than the thickness of said holding member.

9. The image generating apparatus according to claim 8, further comprising a washer, arranged between said mounting portion of said heat radiation member and said screw member, having a larger outer diameter than said mounting portion of said heat radiation member, for pressing the upper surface of said holding member with said washer by fastening said screw member into said threaded hole of said mounting portion of said heat radiation member through said washer.

10. The image generating apparatus according to claim 1, wherein said heat radiation member is made of aluminum.

11. The image generating apparatus according to claim 1, wherein said heat radiation member is provided with a boss while said holding member is provided with a boss receiving hole capable of receiving said boss of said heat radiation member.

12. An image generating apparatus comprising:

a print head;

a heat radiation member arranged on the upper surface of said print head;

a rotary arm integrally formed on said heat radiation member for rotatably supporting said print head;

a platen roller against which said print head is pressed;

a pressing member for pressing said print head against said platen roller; and a holding member, mounted on the upper surface of said heat radiation member with a screw member, holding a spring member for urging said print head toward said platen roller by being pressed by said pressing member, wherein said heat radiation member is provided with a mounting portion protruding toward the head of said screw member and including a threaded hole meshing with said screw member while a recess portion is provided on a surface of said mounting portion of said heat radiation member closer to said print head for storing a forward end portion, protruding toward said print head, of said screw member mounted on said mounting portion of said heat radiation member, and said holding member includes a mounting portion receiving hole capable of receiving said mounting portion of said heat radiation member protruding toward the head of said screw member and a guide portion for guiding an ink sheet employed for printing with said print head.

13. The image generating apparatus according to claim 12, wherein the amount of protrusion of said mounting portion of said heat radiation member is not more than the thickness of said holding member.

14. The image generating apparatus according to claim 13, further comprising a washer, arranged between said mounting portion of said heat radiation member and said screw member, having a larger outer diameter than said mounting portion of said heat radiation member, for pressing the upper surface of said holding member with said washer by fastening said screw member into said threaded hole of said mounting portion of said heat radiation member through said washer.

15. The image generating apparatus according to claim 12, wherein said mounting portion and said recess portion of said heat radiation member are formed by performing press working from the side of the lower surface of said heat radiation member.

16. The image generating apparatus according to claim 12, wherein said heat radiation member is made of aluminum.

17. The image generating apparatus according to claim 12, wherein said heat radiation member is provided with a boss while said holding member is provided with a boss receiving hole capable of receiving said boss of said heat radiation member.

18. The image generating apparatus according to claim 12, wherein said guide portion is integrally formed on said holding member mounted on the upper surface of said print head so that an end coming into contact with said ink sheet is folded to have a curved outer surface.

* * * * *